US012704302B2

(12) United States Patent
Hoysall et al.

(10) Patent No.: US 12,704,302 B2
(45) Date of Patent: Aug. 11, 2026

(54) CHARGE COMPENSATOR FOR HEAT PUMP

(71) Applicant: Carrier Corporation, Palm Beach Gardens, FL (US)

(72) Inventors: Dhruv Chanakya Hoysall, South Windsor, CT (US); Thomas Bryant, West Seneca, NY (US); Tobias Sienel, Baldwinsville, NY (US); Fatemeh Hejripour Rafsanjani, Jamesville, NY (US); Arindom Joardar, Syracuse, NY (US); Brian Videto, Cortland, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 13 days.

(21) Appl. No.: 18/514,056

(22) Filed: Nov. 20, 2023

(65) Prior Publication Data

US 2024/0167743 A1 May 23, 2024

Related U.S. Application Data

(60) Provisional application No. 63/427,257, filed on Nov. 22, 2022.

(51) Int. Cl.
*F25B 41/40* (2021.01)

(52) U.S. Cl.
CPC ..... *F25B 41/40* (2021.01); *F25B 2400/16* (2013.01)

(58) Field of Classification Search
CPC .. F25B 41/40; F25B 2400/16; F25B 2600/05; F25B 2339/0442; F25B 2339/0443; F28F 9/0231
See application file for complete search history.

(56) References Cited

U.S. PATENT DOCUMENTS 5,101,890 A 4/1992 Aoki et al.
5,228,315 A 7/1993 Nagasaka et al.
5,709,106 A 1/1998 Inaba et al.
5,927,102 A 7/1999 Matsuo et al.
(Continued)

FOREIGN PATENT DOCUMENTS

CN 111947339 A 11/2020
CN 112082402 A 12/2020
(Continued)

OTHER PUBLICATIONS

JP-2000314574-A Translation (Year: 2003).*
(Continued)

*Primary Examiner* — David J Teitelbaum
(74) *Attorney, Agent, or Firm* — CANTOR COLBURN LLP

(57) ABSTRACT

A heating, ventilation, and air conditioning (HVAC) system includes a vapor compression cycle comprising a heat exchanger and an expansion device arranged in fluid communication with the heat exchanger. A fluid is configured to circulate within the vapor compression cycle in a first direction during a first mode and is configured to circulate within vapor compression cycle in a second, opposite direction during a second mode. A receiver is fluidly coupled to the vapor compression cycle at a connection point. The connection point is positioned between the heat exchanger an the expansion device and the receiver is positioned vertically above the connection point.

19 Claims, 8 Drawing Sheets

(56) References Cited

U.S. PATENT DOCUMENTS

| | | | | |
|---|---|---|---|---|
| 5,988,267 | A | 11/1999 | Park et al. | |
| 6,223,556 | B1 | 5/2001 | De et al. | |
| 6,341,647 | B1 | 1/2002 | Nobuta et al. | |
| 6,430,945 | B1 | 8/2002 | Haussmann | |
| 6,505,481 | B2 | 1/2003 | Neumann et al. | |
| 6,684,661 | B1 | 2/2004 | Beasley et al. | |
| 6,694,773 | B1 | 2/2004 | Snow et al. | |
| 7,096,930 | B2 | 8/2006 | Nobuta et al. | |
| 7,243,710 | B2 | 7/2007 | Shinhama | |
| 7,337,832 | B2 | 3/2008 | Hu | |
| 8,250,874 | B2 | 8/2012 | Ikegami et al. | |
| 8,991,479 | B2 | 3/2015 | Fujii et al. | |
| 9,335,077 | B2 | 5/2016 | Hanafusa | |
| 9,464,850 | B2 | 10/2016 | Iino et al. | |
| 9,689,594 | B2 | 6/2017 | Johnson et al. | |
| 9,752,833 | B2 | 9/2017 | Gao et al. | |
| 9,791,190 | B2 | 10/2017 | Hanafusa | |
| 10,330,356 | B2 | 6/2019 | Numasawa | |
| 10,845,124 | B2 | 11/2020 | Sugimura et al. | |
| 2009/0078399 | A1 | 3/2009 | Makita et al. | |
| 2013/0299150 | A1 | 11/2013 | Bellenfant et al. | |
| 2015/0020536 | A1* | 1/2015 | Lee | F25B 45/00 62/324.4 |
| 2015/0330684 | A1* | 11/2015 | Goel | F25B 41/39 137/593 |
| 2017/0276413 | A1 | 9/2017 | Takeichi et al. | |
| 2019/0323747 | A1* | 10/2019 | Giles | F25B 39/04 |
| 2020/0088451 | A1 | 3/2020 | Saito et al. | |
| 2021/0310742 | A1 | 10/2021 | Zhao et al. | |
| 2022/0120481 | A1 | 4/2022 | Hirokawa et al. | |
| 2022/0120504 | A1 | 4/2022 | Yamada et al. | |

FOREIGN PATENT DOCUMENTS

| | | | | |
|---|---|---|---|---|
| EP | 1291592 | A1 | 3/2003 | |
| EP | 2735832 | B1 | 2/2020 | |
| JP | 2000314574 | A * | 11/2000 | |
| KR | 100858514 | B1 | 9/2008 | |
| KR | 101078761 | B1 | 11/2011 | |
| WO | 0101051 | A1 | 1/2001 | |
| WO | WO-2014035134 | A1 * | 3/2014 | F25B 49/02 |
| WO | 2014092152 | A1 | 6/2014 | |
| WO | 2015064172 | A1 | 5/2015 | |
| WO | 2021245788 | A1 | 12/2021 | |

OTHER PUBLICATIONS

WO-2014035134-A1 Translation (Year: 2014).*

Extended European Search Report for European Application No. 23210453.9; Report Mail Date Feb. 6, 2024 (7 Pages).

EPSR OA for application EP 23210453.9, Issued Nov. 14, 2025, 5 pages.

* cited by examiner

CHARGE COMPENSATOR FOR HEAT PUMP

CROSS-REFERENCE TO RELATED APPLICATIONS

This application claims the benefit of U.S. Provisional Application No. 63/427,257, filed Nov. 22, 2022, the contents of which are incorporated by reference herein in their entirety.

BACKGROUND

Exemplary embodiments pertain to the art of heat pump air conditioning systems, and more particularly, to refrigerant charge within a heat pump air conditioning system.

Heat pumps are used in a variety applications, for example, in heating, ventilation, and air conditioning (HVAC) systems that provide a desired air temperature in a facility. Such heat pumps commonly include a compressor, evaporator, expansion device, and condenser. Heat pumps input work to the refrigerant, e.g., by driving the compressor, thereby enabling the refrigerant to move heat from a colder heat reservoir to a warmer heat sink. Some heat pumps are provided as "split" systems, having a first heat exchanger arranged inside of the building to be conditioned and a second heat exchanger located outside of the building to be conditioned. When such a heat pump operates in a heating mode, the second heat exchanger operating as an evaporator is disposed outside the building.

Heat pumps typically have a charge imbalance between operation in the heat and cooling modes. Existing charge management strategies are not large enough to store the excess charge that occurs when the heat pump is in a heating mode. The charge imbalance can damage the system, lead to drops in performance, system shut downs etc. Further, this charge imbalance can be exacerbated with the use of a microchannel heat exchanger coil in the heat pump.

BRIEF DESCRIPTION

According to an embodiment a heating, ventilation, and air conditioning (HVAC) system includes a vapor compression cycle comprising a heat exchanger and an expansion device arranged in fluid communication with the heat exchanger. A fluid is configured to circulate within the vapor compression cycle in a first direction during a first mode and is configured to circulate within vapor compression cycle in a second, opposite direction during a second mode. A receiver is fluidly coupled to the vapor compression cycle at a connection point. The connection point is positioned between the heat exchanger an the expansion device and the receiver is positioned vertically above the connection point.

In addition to one or more of the features described herein, or as an alternative, further embodiments may include the heat exchanger further comprises an outlet and the receiver is positioned vertically above the outlet of the heat exchanger.

In addition to one or more of the features described herein, or as an alternative, further embodiments may include the heat exchanger further comprises an outlet and the receiver is positioned vertically below the outlet of the heat exchanger.

In addition to one or more of the features described herein, or as an alternative, further embodiments may include the connection point is arranged downstream from the heat exchanger and upstream from the expansion device relative to a flow of fluid through the vapor compression cycle in the first mode.

In addition to one or more of the features described herein, or as an alternative, further embodiments may include the connection point is arranged upstream from the heat exchanger and downstream from the expansion device relative to the flow of fluid through the vapor compression cycle in the second mode.

In addition to one or more of the features described herein, or as an alternative, further embodiments may include the first mode is a cooling mode and the second mode is a heating mode.

In addition to one or more of the features described herein, or as an alternative, further embodiments may include the heat exchanger further comprises an outlet header and the connection point is arranged at the outlet header.

In addition to one or more of the features described herein, or as an alternative, further embodiments may include the receiver further comprises a receiver body and at least one receiver conduit extending between the receiver body and the connection point.

In addition to one or more of the features described herein, or as an alternative, further embodiments may include the receiver body has a horizontal configuration.

In addition to one or more of the features described herein, or as an alternative, further embodiments may include the receiver body is angled relative to a horizontal plane.

In addition to one or more of the features described herein, or as an alternative, further embodiments may include the at least one receiver conduit is connected to a vertically lowest portion of the receiver body.

In addition to one or more of the features described herein, or as an alternative, further embodiments may include the at least one receiver conduit further comprises a plurality of receiver conduits.

In addition to one or more of the features described herein, or as an alternative, further embodiments may include the at least one receiver conduit extends at an angle relative to a horizontal plane.

In addition to one or more of the features described herein, or as an alternative, further embodiments may include the at least one receiver conduit includes a bend.

In addition to one or more of the features described herein, or as an alternative, further embodiments may include the receiver further comprises a receiver cap movably coupled to the receiver body to adjust an internal volume defined between the receiver body and the receiver cap.

In addition to one or more of the features described herein, or as an alternative, further embodiments may include the receiver cap is threadably coupled to the receiver body.

In addition to one or more of the features described herein, or as an alternative, further embodiments may include the receiver cap is movable to increase the internal volume defined between the receiver body and the receiver cap by up to about 50%.

In addition to one or more of the features described herein, or as an alternative, further embodiments may include the heat exchanger is a microchannel heat exchanger.

In addition to one or more of the features described herein, or as an alternative, further embodiments may include the air conditioning system is a heat pump having an indoor unit and an outdoor unit, the heat exchanger being arranged within the indoor unit.

The foregoing features and elements may be combined in various combinations without exclusivity, unless expressly indicated otherwise. Features which are described in the context of separate aspects and embodiments may be used together and/or be interchangeable. Similarly, features described in the context of a single embodiment may also be provided separately or in any suitable subcombination. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
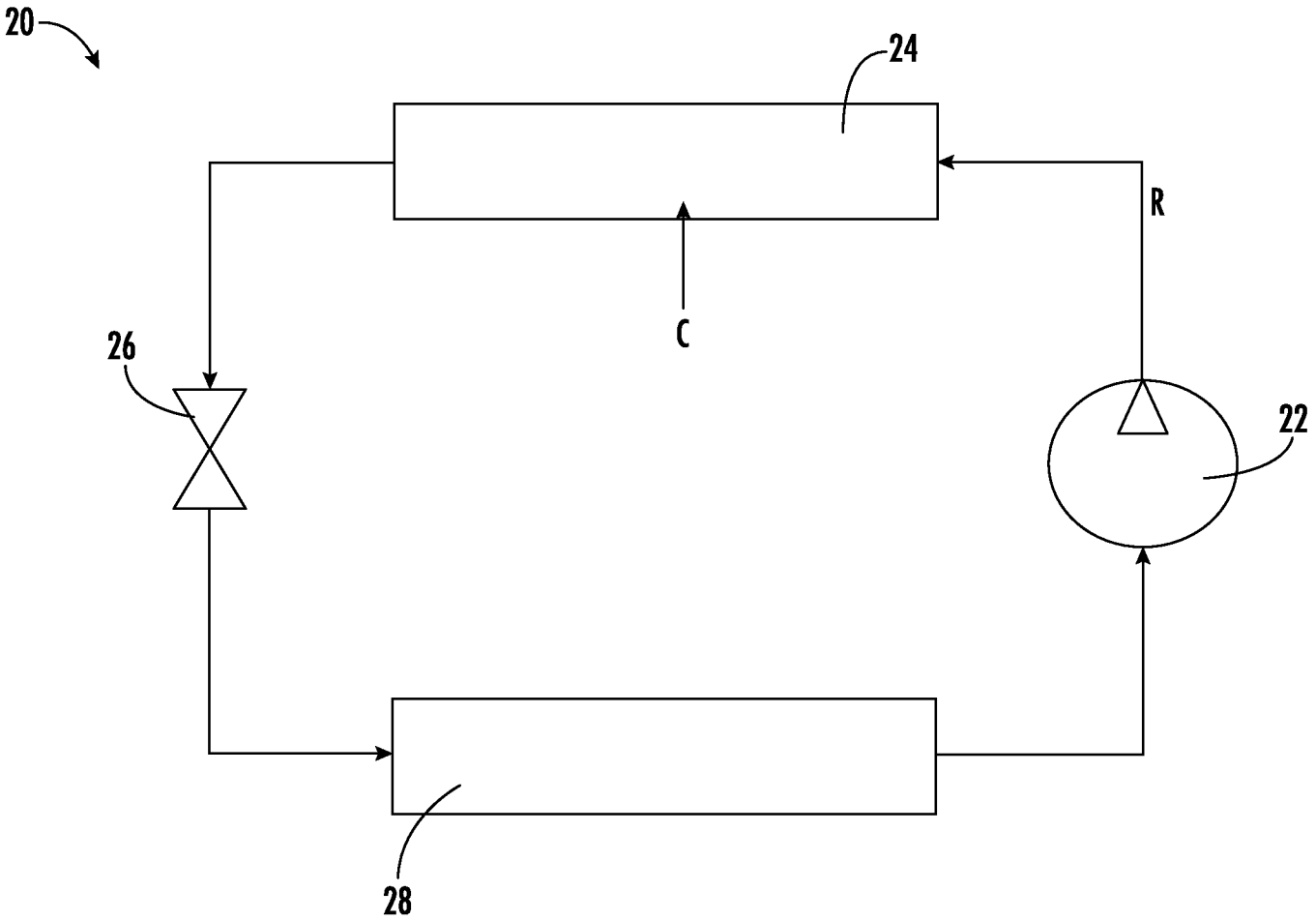
FIG. 1 is a schematic diagram of an exemplary heat pump according to an embodiment.
Figure 2:
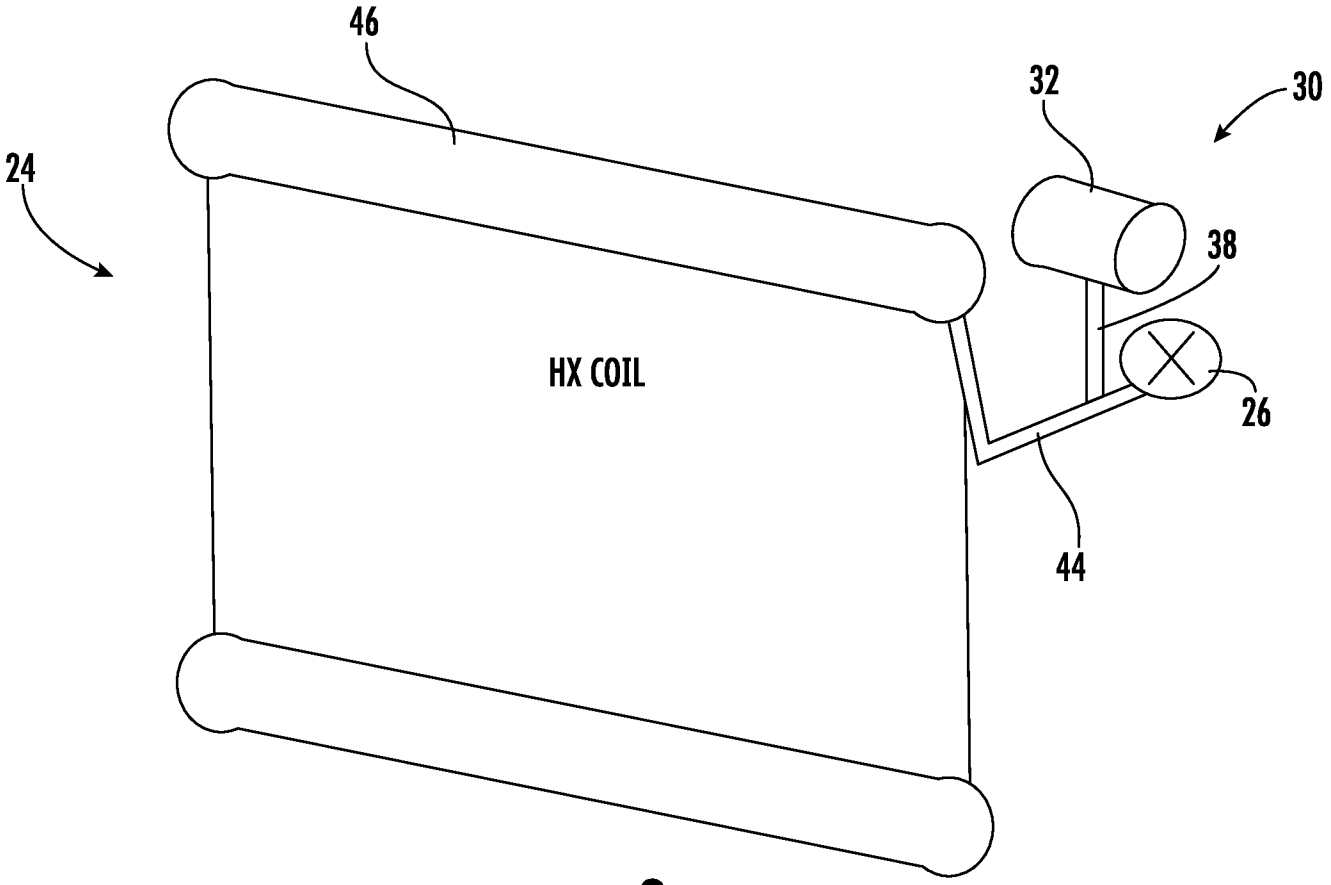
FIG. 2 is a perspective view of a portion of a heat pump including a receiver according to an embodiment.
Figure 3:
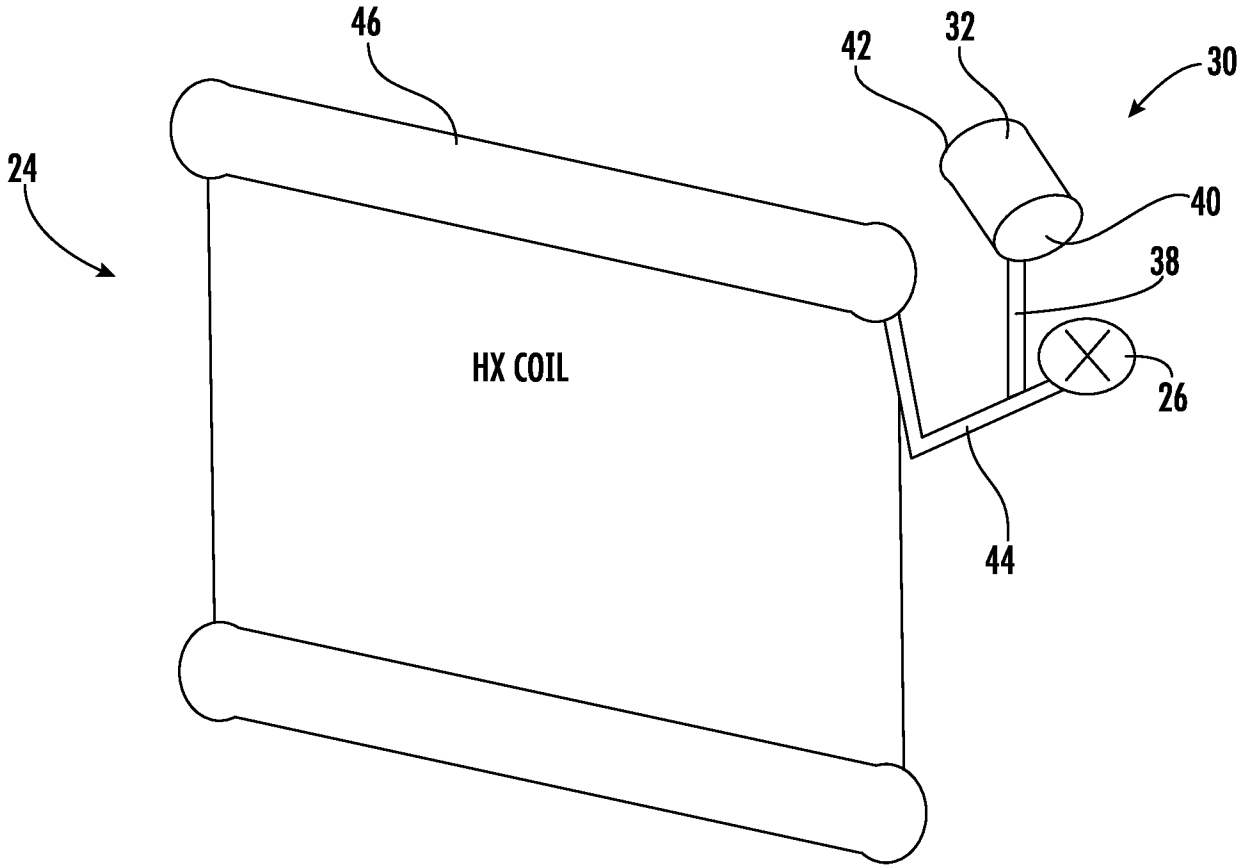
FIG. 3 is a perspective view of a portion of a heat pump including a receiver according to another embodiment.

With reference now to FIG. 1, a schematic diagram of an example of a basic vapor compression cycle of a heating, ventilation, and air conditioning (HVAC) system 20 is illustrated. The vapor compression cycle includes one or more compressors 22, a first heat exchanger 24, an expansion device 26, and a second heat exchanger 28. The first heat exchanger 24 and the second heat exchanger 28 may be configured with different internal volumes. In an embodiment, the first heat exchanger 24 is a microchannel heat exchanger having a plurality of flattened heat exchange tube segments extending between two headers, the interior flow passage of each heat exchange tube segment being divided by interior walls into a plurality of discrete flow channels that extend longitudinally over the length of the tube. Alternatively, or in addition, in an embodiment, the second heat exchanger 28 has a round tube plate fin configuration. However, embodiments where the first heat exchanger 24 and/or the second heat exchanger 28 is another suitable type of heat exchanger are also contemplated herein. A fluid, such as a refrigerant for example, is configured to circulate through the vapor compression cycle, such as in a counterclockwise direction for example.

In operation, the compressor 22 receives a refrigerant vapor from the second heat exchanger 28 and compresses it to a high temperature and pressure. The relatively hot refrigerant vapor is then delivered to the first heat exchanger 24 where it is cooled and condensed to a liquid state via heat exchange relationship with a cooling medium C, such as air or water. Accordingly, when the first heat exchanger 24 receives the refrigerant output from the compressor 22, the first heat exchanger functions as a condenser. The cooled liquid refrigerant flows from the first heat exchanger 24 to the expansion device 26, such as an expansion valve for example, in which the refrigerant is expanded to a lower pressure where the temperature is reduced and the refrigerant may exist in a two phase liquid/vapor state. From the expansion device 26, the refrigerant is provided to the second heat exchanger 28. Because heat is transferred from a secondary medium, such as air for example, to the refrigerant within the second heat exchanger 28, causing any refrigerant in the liquid phase to vaporize, the second heat exchanger 28 functions as an evaporator. From the second heat exchanger 28, the low-pressure vapor refrigerant returns to the compressor 22 so that the cycle may be repeated. This flow of refrigerant within the vapor compression cycle of the HVAC system 20 may be referred to herein as operation in a normal or cooling mode.

In embodiments where the HVAC system 20 is a heat pump, the flow of refrigerant within the vapor compressor cycle may be reversed for operation in a heating mode. In such embodiments, the refrigerant may flow clockwise from the compressor 22 to the second heat exchanger 28, the expansion device 26, and the first heat exchanger 24 sequentially. In such instances, the refrigerant within the second heat exchanger 28 is cooled and condensed to a liquid state and the refrigerant within the first heat exchanger is heated to form a low-pressure vapor. Accordingly, when operating in this reverse flow direction, the second heat exchanger 28 functions as the condenser and the first heat exchanger 24 functions as the evaporator of the vapor compression cycle. In embodiments where the flow of refrigerant within the HVAC system 20 is reversible to allow operation in both a cooling and heating mode, the component of the HVAC system 20 may be divided between an indoor unit and an outdoor unit, as is known in the art. In such embodiments, the first heat exchanger 24 is arranged within the indoor unit and the second heat exchanger 28 is arranged within the outdoor unit.

With reference now to FIGS. 2-8, in an embodiment, the HVAC system 20 additionally includes a receiver or compensator 30. As shown, the receiver 30 may include a substantially hollow receiver body 32. Although the receiver body 32 is illustrated as being generally cylindrical in shape, it should be understood that a receiver body 32 having another suitable shape, such as a rectangular or cubic shape for example, is also contemplated herein. Further, the overall size of the receiver body 32 and/or the total internal volume of the hollow interior of the receiver body 32 may be equal to or less than the volume associated with the difference in refrigerant charge between the cooling mode and the heating mode. In an embodiment, the total volume of the hollow interior of the receiver body 32 is less than or equal to the difference in the internal volumes of the first heat exchanger 24 and the second heat exchanger 28.

Figure 4:
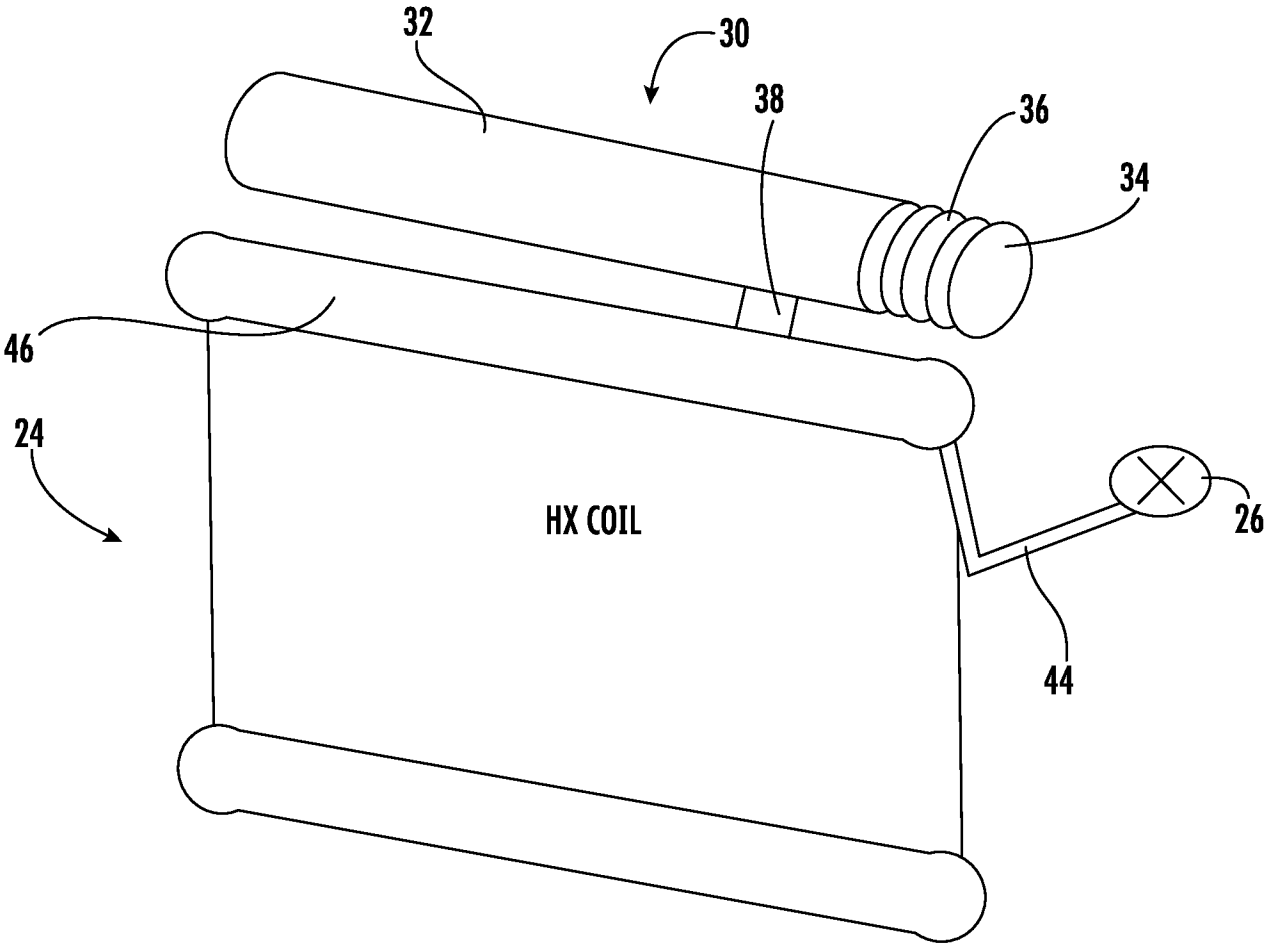
FIG. 4 is a perspective view of a portion of a heat pump including an adjustable volume receiver according to an embodiment.
Figure 5:
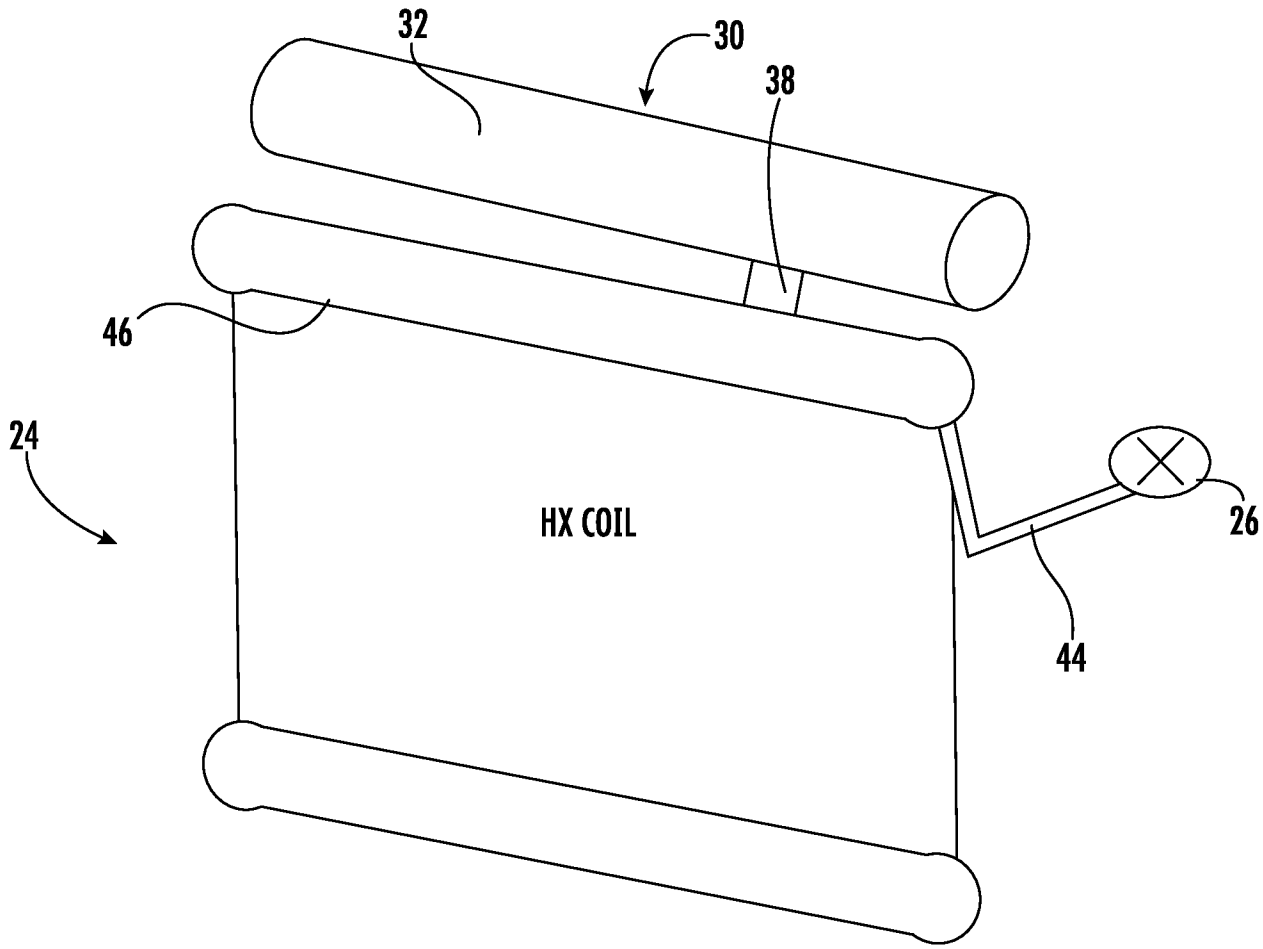
FIG. 5 is a perspective view of a portion of a heat pump including a receiver according to another embodiment.
Figure 6:
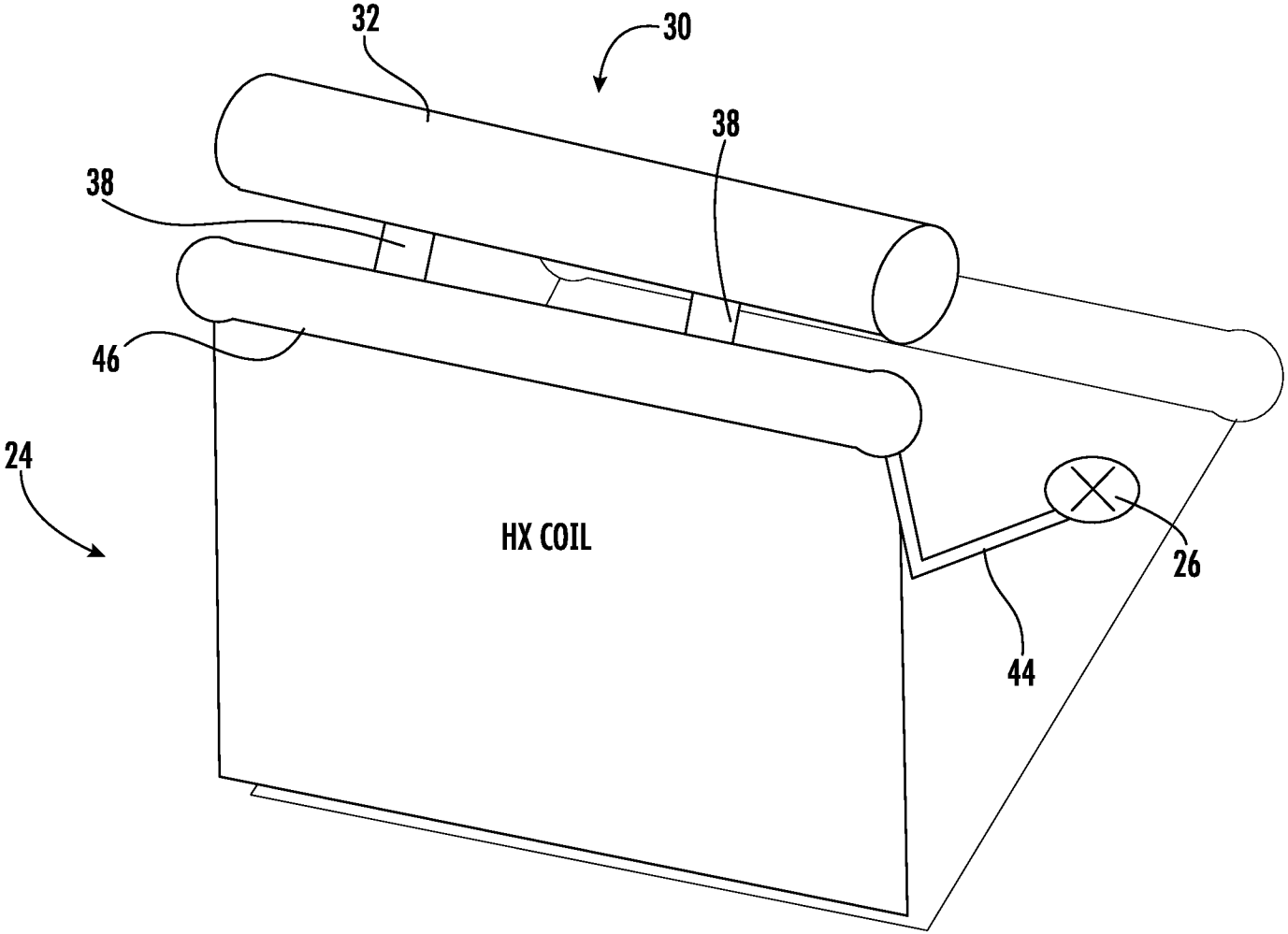
FIG. 6 is a perspective view of a portion of a heat pump including a receiver according to another embodiment.
Figure 7:
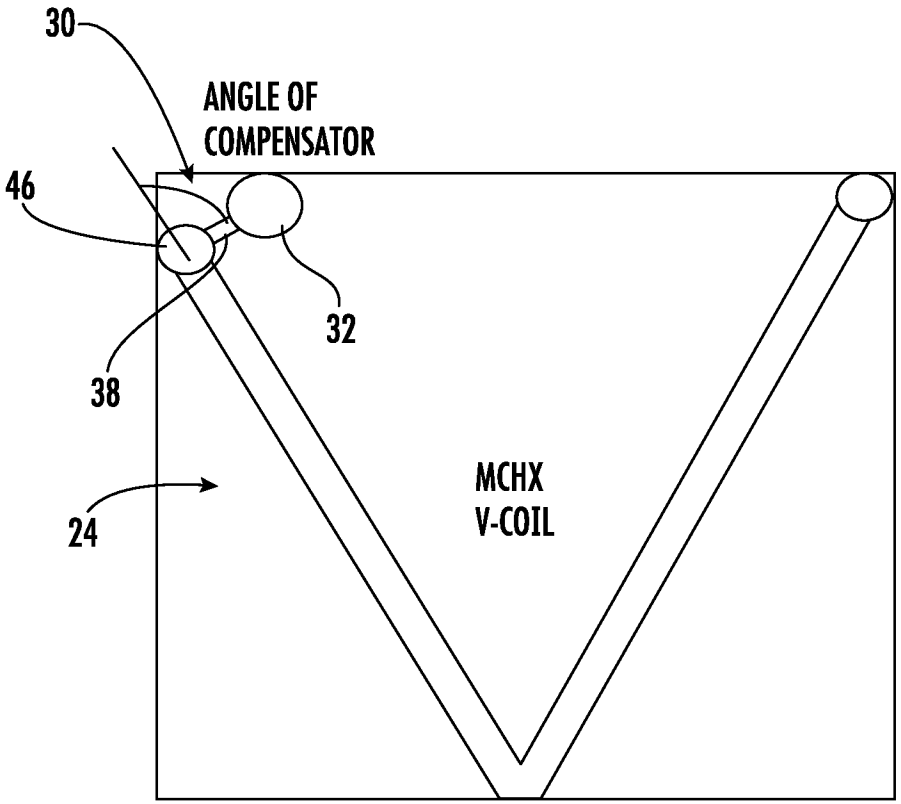
FIG. 7 is an end view of a portion of a heat pump including a receiver according to another embodiment.
Figure 8:
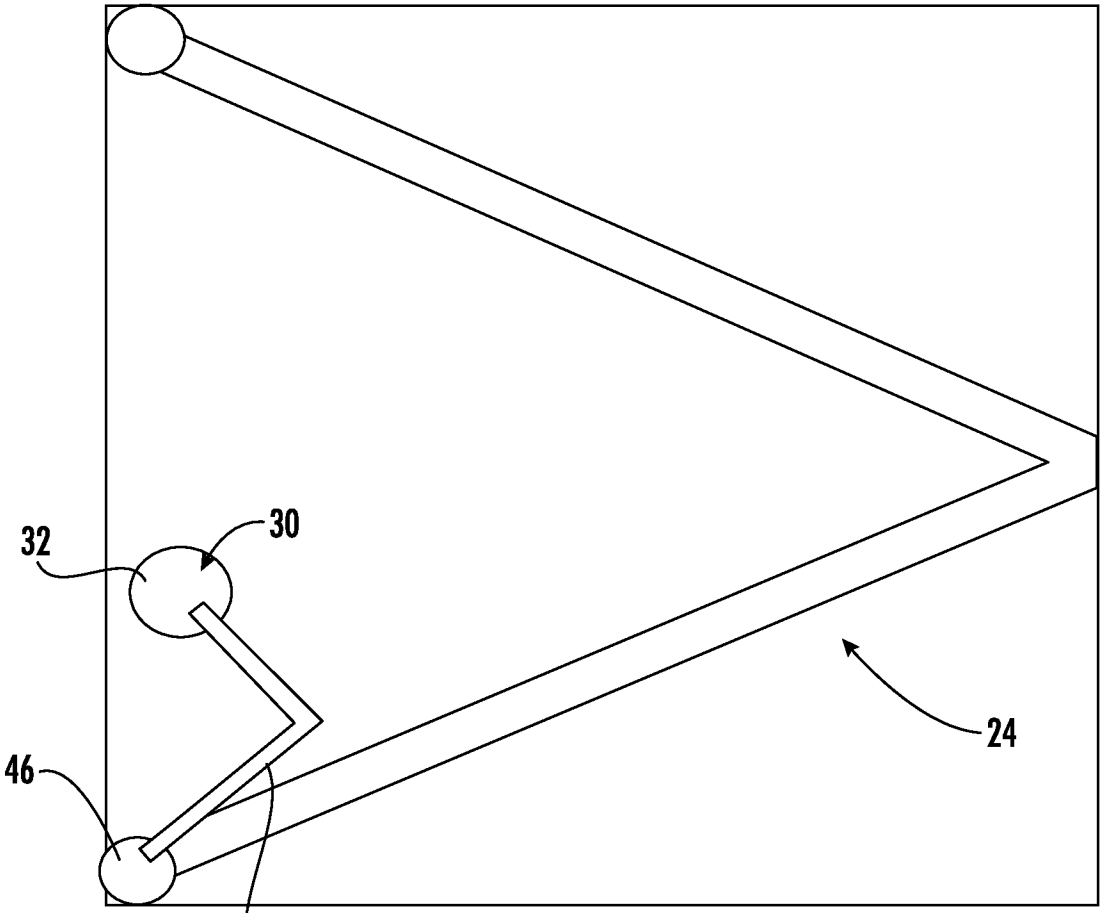
FIG. 8 is an end view of a portion of a heat pump including a receiver according to another embodiment.

With reference to FIG. 4, in an embodiment, the receiver body 32 includes an open end (not shown), and a receiver cap 34 is movably coupled to the open end to substantially seal the open end of the receiver body 32. In the illustrated, non-limiting embodiment, each of the receiver body 32 and the receiver cap 34 includes a plurality of threads 36. Accordingly, as the receiver cap 34 is rotated about an axis, the plurality of threads formed int eh receiver cap 34 mesh or interlock with the plurality of threads of the receiver body to couple the receiver cap 34 to the receiver body 32 and/or to move the receiver cap 34 relative to the receiver body 32. The receiver cap 34 may but need not be detachable or wholly separable from the receiver body 32. However, movement of the receiver cap 34 relative to the receiver body 32, such as by controlling the portion of the intermeshed plurality of threads for example, may be used to move the receiver cap 34 axially to vary the total volume of the hollow interior. In an embodiment, the receiver cap 34 is movable relative to the receiver body 32 to increase the volume of the hollow interior defined between the receiver body 32 and the receiver cap 34 by up to about 50%.

At least one receiver conduit 38 extends from and is fluidly connected to the hollow interior of the receiver body 32. The receiver body 32 and the receiver conduit 38 may be permanently connected or may be separable from one another. In embodiments where the receiver body 32 and the one or more receiver conduits 38 are permanently connected, the receiver body 32 and the receiver conduit(s) 38 may be integrally formed. The receiver conduit 38 may have a generally linear configuration, or alternatively, may have one or more bends or angles formed therein (see FIG. 8).

When the receiver 30 is connected to the vapor compression cycle of the HVAC system 20, the receiver body 32 may be arranged in any suitable orientation, such as selected based on performance and/or air resistance. In an embodiment, as shown in FIGS. 2 and 4-6, the receiver body 32 has a generally horizontal configuration. In another embodiment, shown in FIG. 3, the receiver body 32 may be arranged at an angle relative to a horizontal plane such that a first end 40 of the receiver body 32 is arranged vertically lower than a second end 42 of the receiver body 32. The at least one receiver conduit 38 may be connected to the lowest portion of the receiver body 32 measured relative to a vertical plane. By connecting the receiver conduit 38 to the lowest portion of the receiver body 32, the substantial entirety of the refrigerant within the interior of the receiver body 32 will flow via gravity to the receiver conduit 38.

The receiver 30 may be positioned downstream from a portion of the first heat exchanger 24 relative to the flow of refrigerant R when the HVAC system 20 is operating in a normal or cooling mode. In the illustrated, non-limiting embodiment, the receiver 30 is positioned between the outlet of the first heat exchanger 24 and the inlet of the thermal expansion valve 26. For example, as shown in FIGS., the receiver conduit 38 is arranged in fluid communication with a portion of the vapor compression cycle, such as a conduit 44 extending between the first heat exchanger 24 and the thermal expansion valve 26 for example, at a connection point.

In other embodiments, the receiver conduit 38 is directly connected to the outlet header 46 of the first heat exchanger 24. In such embodiments, the receiver body 32, or the receiver body 32 and receiver cap 34 in combination may but need not be equal in length to the axial length of the outlet header. When the receiver 30 is mounted directly to the outlet header 46, a single receiver conduit 38 (FIGS. 4, 5), or alternatively, a plurality of receiver conduits 38 (FIG. 6) may fluidly couple the interior of the receiver body 32 to the interior of the outlet header 46. In embodiments including a plurality of receiver conduits 38, the receiver conduits may be spaced apart from one another over the axial length of the outlet header 46, or may be clustered together.

When the receiver 30 is attached to the HVAC system 20, the receiver body 32 is positioned vertically above the connection point. The receiver body 32 may but need not be positioned vertically above the outlet or outlet header 46 of the first heat exchanger 24. As a result, the receiver conduit 38 may extend at any suitable angle relative to the horizontal plane of the connection point, such as between about 1° and about 90°. In embodiments including a plurality of receiver conduits 38, the receiver conduits 38 may be substantially identical, or may be different, and may extend from the receiver body 32 with the same orientation or with different orientations.

During operation of the HVAC system 20 in the heating mode, as a result of the extra refrigerant charge, the receiver 30 is configured to fill with refrigerant. The refrigerant accumulated within the receiver 30 is effectively removed from circulation within the vapor compression cycle. Similarly, in the cooling mode, the receiver fills with gaseous refrigerant which is thereby effectively removed from the circulating system. Because liquid refrigerant is effectively removed from the system in the heating mode and gaseous refrigerant is effectively removed from the system in the cooling mode, the effective mass of the refrigerant is different for each mode of operation, but the mass removal from cooling mode is not significant.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, and air conditioning (HVAC) system comprising:

a vapor compression cycle comprising a heat exchanger and an expansion device arranged in fluid communication with the heat exchanger, wherein a fluid is configured to circulate within the vapor compression cycle in a first direction during a first mode and is configured to circulate within vapor compression cycle in an opposite second direction during a second mode; and a receiver fluidly coupled to the vapor compression cycle at a connection point, the connection point being positioned between the heat exchanger and the expansion device, wherein the receiver is positioned vertically above the connection point and above the heat exchanger and a longitudinal axis of the receiver is oriented parallel to a header of the heat exchanger.

2. The HVAC system of claim 1, wherein the heat exchanger further comprises an outlet and the receiver is positioned vertically above the outlet of the heat exchanger.

3. The HVAC system of claim 1, wherein the heat exchanger further comprises an outlet and the receiver is positioned vertically below the outlet of the heat exchanger.

4. The HVAC system of claim 1, wherein the connection point is arranged downstream from the heat exchanger and upstream from the expansion device relative to a flow of fluid through the vapor compression cycle in the first mode.

5. The HVAC system of claim 4, wherein the connection point is arranged upstream from the heat exchanger and downstream from the expansion device relative to the flow of fluid through the vapor compression cycle in the second mode.

6. The HVAC system of claim 1, wherein the first mode is a cooling mode and the second mode is a heating mode.

7. The HVAC system of claim 1, wherein the heat exchanger further comprises an outlet header and the connection point is arranged at the outlet header.

8. The HVAC system of claim 7, wherein the receiver further comprises a receiver body and at least one receiver conduit extending between the receiver body and the connection point.

9. The HVAC system of claim 8, wherein the receiver body has a horizontal configuration.

10. The HVAC system of claim 8, wherein the receiver body is angled relative to a horizontal plane.

11. The HVAC system of claim 8, wherein the at least one receiver conduit is connected to a vertically lowest portion of the receiver body.

12. The HVAC system of claim 8, wherein the at least one receiver conduit further comprises a plurality of receiver conduits.

13. The HVAC system of claim 8, wherein the at least one receiver conduit extends at an angle relative to a horizontal plane.

14. The HVAC system of claim 8, wherein the at least one receiver conduit includes a bend.

15. The HVAC system of claim 8, wherein the receiver further comprises a receiver cap movably coupled to the receiver body to adjust an internal volume defined between the receiver body and the receiver cap.

16. The HVAC system of claim 15, wherein the receiver cap is threadably coupled to the receiver body.

17. The HVAC system of claim 15, wherein the receiver cap is movable to increase the internal volume defined between the receiver body and the receiver cap by up to 50%.

18. The HVAC system of claim 1, wherein the heat exchanger is a microchannel heat exchanger.

19. The HVAC system of claim 1, wherein the air conditioning system is a heat pump having an indoor unit and an outdoor unit, the heat exchanger being arranged within the indoor unit.

* * * * *